US006789776B1

(12) United States Patent
Gavin

(10) Patent No.: US 6,789,776 B1
(45) Date of Patent: Sep. 14, 2004

(54) CAST-IN ANCHOR ATTACHMENT APPARATUS

(76) Inventor: Norman W. Gavin, 2545 Ridge Rd., North Haven, CT (US) 06473

( * ) Notice: Subject to any disclaimer, the term of this patent is extended or adjusted under 35 U.S.C. 154(b) by 208 days.

(21) Appl. No.: 10/237,905

(22) Filed: Sep. 9, 2002

Related U.S. Application Data

(62) Division of application No. 09/575,385, filed on May 22, 2000, now abandoned.

(51) Int. Cl.[7] ..... B28B 23/00

(52) U.S. Cl. ..... 249/61; 249/94; 249/96; 249/205; 52/699; 52/705; 411/82; 411/397

(58) Field of Search ..... 249/59, 61, 94, 249/96, 205; 52/699, 705; 411/82, 397, 908

(56) References Cited

U.S. PATENT DOCUMENTS

| | | | | |
|---|---|---|---|---|
| 2,096,062 A | * | 10/1937 | Phillips | 52/699 |
| 3,355,534 A | | 11/1967 | Groff | |
| 3,418,781 A | * | 12/1968 | Penote | 52/699 |
| 3,557,274 A | | 1/1971 | Kowell | |
| 3,685,782 A | | 8/1972 | Kowell | |
| 3,685,783 A | | 8/1972 | Nilson | |
| 3,764,066 A | | 10/1973 | Kowell | |
| 3,982,363 A | * | 9/1976 | Dorris | 52/98 |
| 4,023,257 A | | 5/1977 | Wright et al. | |
| 4,083,162 A | | 4/1978 | Regan et al. | |
| 4,143,193 A | | 3/1979 | Rees | |
| 4,725,859 A | | 2/1988 | Shibata et al. | |
| 5,126,095 A | | 6/1992 | Crosno et al. | |
| 5,186,883 A | | 2/1993 | Beall, III | |

FOREIGN PATENT DOCUMENTS

| | | |
|---|---|---|
| DE | 3347665 A1 | 7/1985 |
| GB | 2107753 A | 5/1983 |

* cited by examiner

*Primary Examiner*—Robert Davis
*Assistant Examiner*—Donald Heckenberg
(74) *Attorney, Agent, or Firm*—Robert A. Seemann

(57) ABSTRACT

An anchor having an internally threaded first opening, a body, a first end on the body threaded to fit the first opening, a second end on the body, configured to fit an opening in the wall of the mold for extending a first length of the body into the wall, a second opening in the second end extending toward the first end, and a protrusion in the second opening configured for receiving a tool for transferring rotational force about an axis through the first end and the second end for withdrawing the body from the anchor. The protrusion is recessed the first length from the second end. An annular member extends radially from the body, one axial end of the protrusion is at the axial position of the annular member.

7 Claims, 4 Drawing Sheets

CAST-IN ANCHOR ATTACHMENT APPARATUS

This is a division of application Ser. No. 09/575,385, filed May 22, 2000, abandoned.

BACKGROUND OF THE INVENTION

1. Field of the Invention

The invention relates to attachment elements for a cast tank, conduit or vessel, more particularly to an attachment apparatus for casting an internally threaded anchor in the wall of the tank, conduit or vessel.

In the ensuing description of the invention, the meaning of the term "vessel" includes and is not limited to tank, vessel and conduit.

The internally threaded anchor is preferably installed so that it is open to the inside of the vessel, but can be installed so that it is open toward the outside of the vessel.

2. Description of the Prior Art

In FIGS. 1–3, PRIOR ART attachment apparatus 100 includes solid plastic stud 104 and internally threaded anchor 108. Base 114 of stud 104 screws into opening 106 of anchor 108 until washer 112 seats against annular face 102. Pin 110 is inserted into a wall of the mold and concrete is poured into the mold. The concrete surrounds anchor 108 and hardens. When the concrete vessel is withdrawn from the mold, stud 104 breaks at annular groove 118. Pin 110 remains in the mold wall, and anchor 108 containing threaded base 114 and washer 112 remains in the concrete wall. It is difficult to install stud 104 in anchor 108 when wearing work gloves, or, if the threads are contaminated with worksite dust. It is difficult to remove the remains of stud 104 from the vessel and from the mold wall without drilling the stud and the pin.

U.S. Pat. No. 3,557,274 patented Jan. 19, 1971 by E. L. Kowell describes a smooth rod bolted to a wall of a concrete mold form for a railroad tie, so that the rod extends into the form. An internally smooth, externally threaded, plastic sleeve that is closed at one end is mounted on the rod. An internally threaded anchor is screwed onto the plastic sleeve. Concrete is poured into the form and allowed to harden. The mold with post is slipped off the concrete tie withdrawing the post from the plastic sleeve. The sleeve is then screwed out of the anchor.

SUMMARY OF THE INVENTION

It is one object of the invention to provide an attachment apparatus for a molded wall in which a molding seal portion of the apparatus can be mounted in an anchor portion by a simple tool It is one object of the invention to provide an attachment apparatus for a molded wall in which a molding seal portion of the apparatus can be easily removed from the apparatus after molding.

It is another object that a remnant of the seal portion can be easily removed form the mold wall after molding.

An apparatus for casting an internally threaded anchor in a mold having a mold wall, includes an anchor having an internally threaded first opening, a body a first end on the body threaded to fit the first opening, a second end on the body, configured to fit an opening in the wall of the mold for extending a first length of the body into the wall, a second opening in the second end extending toward the first end, and a protrusion in the second opening configured for receiving a tool for transferring rotational force about an axis through the first end and the second end for withdrawing the body from the anchor. Preferably the protrusion is recessed the first length from the second end. An annular member extends radially from the body, one axial end of the protrusion is at the axial position of the annular member.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
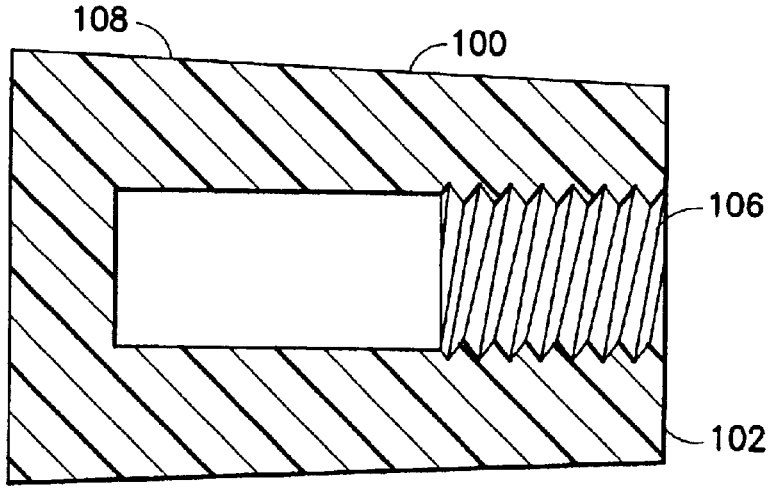
FIG.1 PRIOR ART
FIG. 1 is a cross section view of an internally threaded anchor of a PRIOR ART attachment apparatus.
Figure 2:
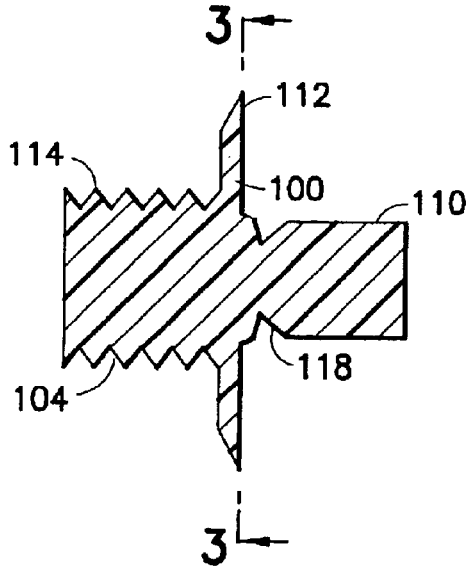
FIG.2 PRIOR ART
FIG. 2 is a cross section view of a stud of the PRIOR ART attachment apparatus.
Figure 3:
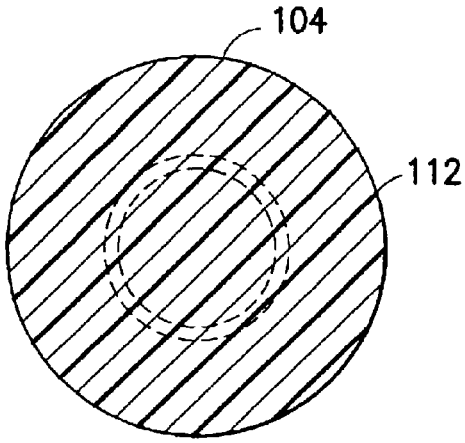
FIG.3 PRIOR ART
FIG. 3 is a cross section view of the stud of the PRIOR ART attachment apparatus of FIG. 2, viewed along 3—3 after a break-off pin is removed.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Figure 4:
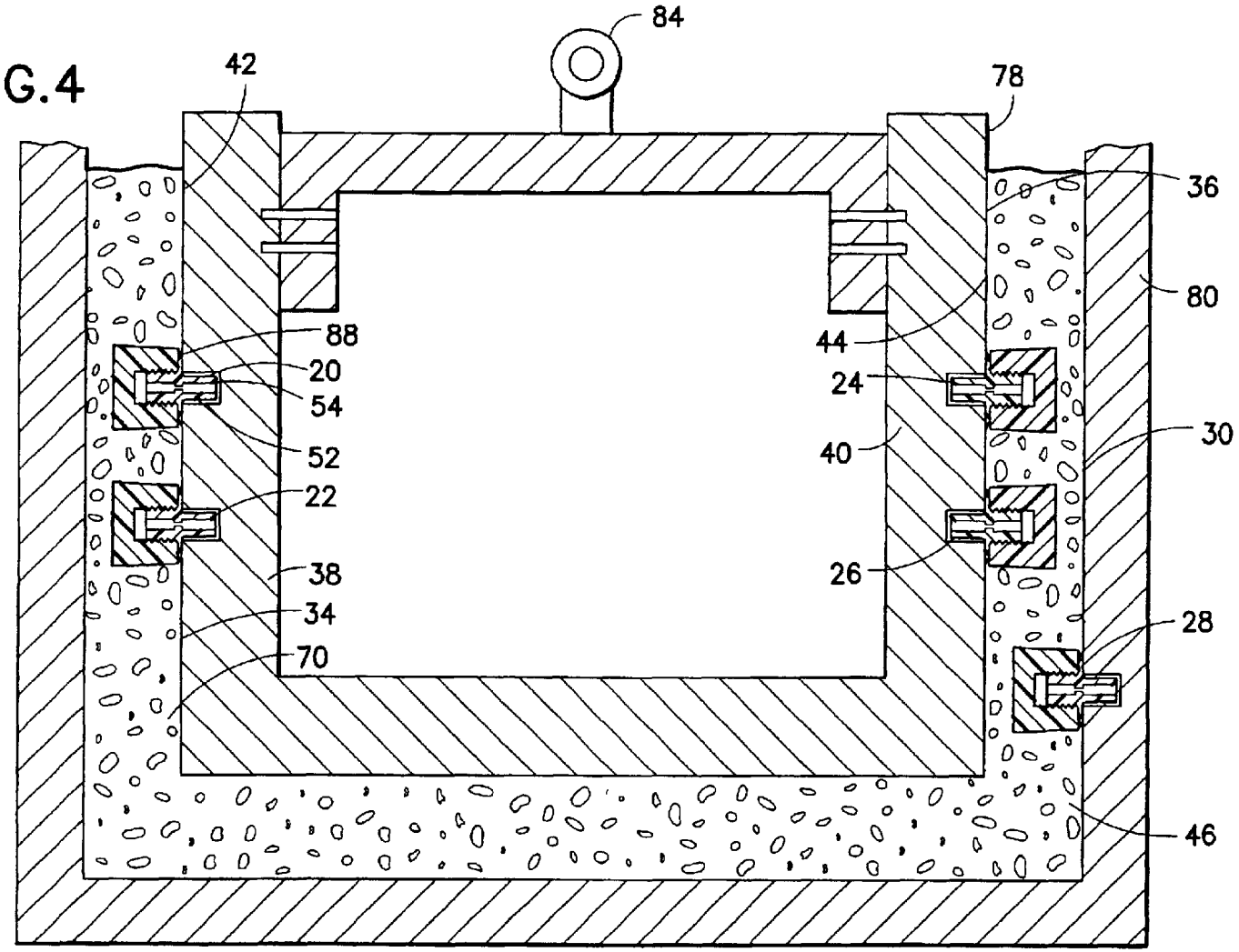
FIG. 4 is a cross section view of a steel mold for forming a concrete tank, the inner wall of the mold and the concrete within the mold each containing portions of five attachment apparatus of the invention.

In FIG. 4, attachment apparatuses 20, 22, 24, and 26 are mounted in outer sides 34, 36 of steel inner walls 38, 40 that form inner sides 42, 44 of the concrete shell 46 of a tank. Attachment apparatus 28 is mounted in the inner side 30 of mold outer shell 80.

Figure 5:
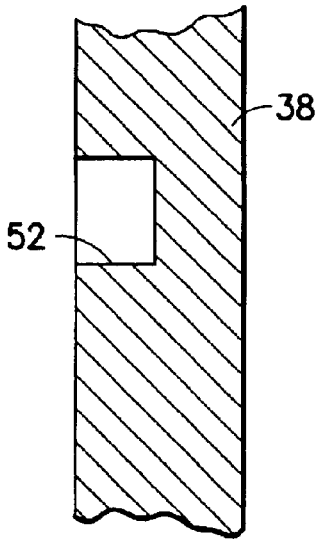
FIG. 5 is a cross section view of a portion of the inner wall of the mold comprising a recess for receiving and holding a portion of the apparatus of the invention.
Figure 6:
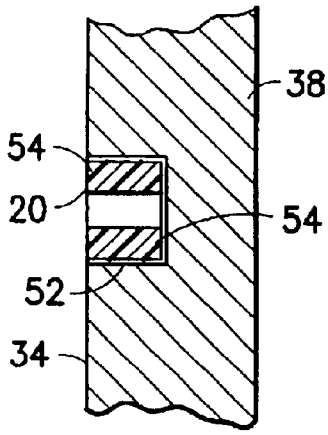
FIG. 6 is a cross section view of the portion of FIG. 2 containing a portion of a apparatus of the invention.

Referring to FIGS. 4, 5 and 6, cavity 52 in wall 38 is designed to snugly receive pin 54 portion of apparatus 20 which provides axially slidable close radial fit in the cavity.

In FIG. 6, pin 54 is shown in cavity 52. The pin is sheared off from threaded portion 62 of apparatus 20.

Figure 7:
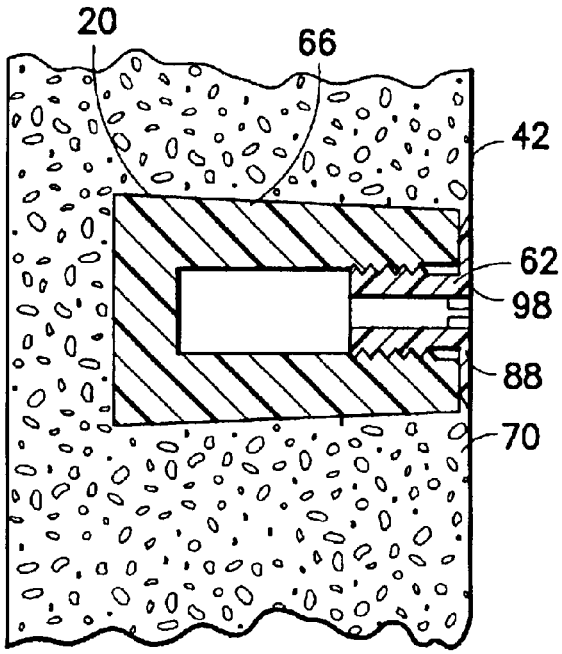
FIG. 7 is a cross section view of a portion of the concrete wall formed by the mold, containing the remaining portion of the apparatus in FIG. 2.
Figure 8:
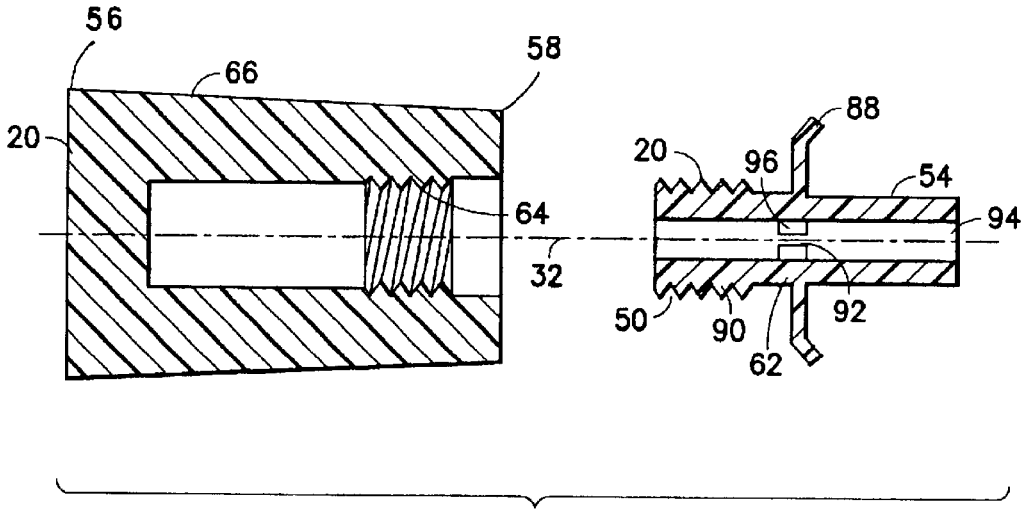
FIG. 8 is an exploded cross section view of the apparatus of FIGS. 4–7.

Referring to FIGS. 4, 7 and 8, threaded seal portion 62 of apparatus 20 is screwed into end 58 of anchor portion 66 of apparatus 20 which is cast into concrete wall 70 of shell 46, permanently anchored in the concrete by the larger end 56 of anchor portion 66. Threads 50 around axis 32 of pin 54 mate with threads 64 of anchor portion 66.

To install apparatus 20 in concrete wall 70, the apparatus is first mounted in steel wall 38 by inserting pin portion 54 into cavity 52. The other apparatuses 22, 24, 26 and 28 are installed in inner walls 38, 40, and outer wall 80 in a similar way. Then liquid concrete is poured into the space between the mold steel inner shell 78 and the mold steel outer shell 80 and allowed to harden.

After the concrete hardens into a concrete shell 46, inner mold shell 78 is hydraulically drawn by way of ring 84 or by other means, out of concrete shell 46, simultaneously shearing pin 54 from threaded portion 62, as outer side 34 of inner wall 38 slides over inner side 42 of concrete wall 70.

Removing concrete shell 46 from mold outer shell 80 shears the pin from apparatus 28.

The drawing out of mold inner shell 78 similarly shears the pins from apparatuses 22, 24, and 26.

Washer 88 which was flush with mold inner shell 78 is left generally planar with inner side 42 of the concrete wall so that the threaded seal portion 62 can be screwed out from anchor 66 leaving a slightly recessed opening in the concrete wall that is lined with threaded anchor 66 for receiving hardware for supporting cable, pipe or other things in the concrete tank, conduit or vessel. Washer 88 is preferably bell shaped.

Figure 9:
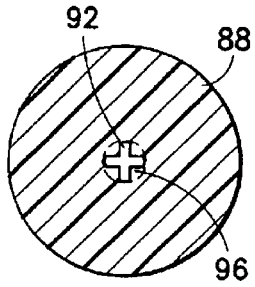
FIG. 9 is a cross section view of the threaded seal element of FIG. 8 after a break-off pin is removed.

Referring to FIGS. 8 and 9, threaded base 90 of one piece plastic threaded seal portion 62 comprises radial grooves 92 for receiving a tool having radial protrusions for applying turning torque to base 90 for unscrewing it from the cast-in anchor portion. The radial grooves can be screwdriver slotted, Phillips slotted, hex slotted or other design for receiving a tool for applying turning torque to the base. The radial grooves are exposed in the recessed opening formed by the anchor in the cast wall after the pin is sheared off as shown in FIGS. 4, 7, 8 and 9.

Inwardly extending ridges 96 that form radial grooves 92 extend along at least a portion of the length of the threaded base to the plane of washer 88 and stop at the shear off plane 98 of pin 54 so that they provide a change in strength for braking of the threaded seal portion at the shear off plane.

Preferably pin portion 54 is tubular, to help remove the pin from the mold wall after the pin is sheared from the threaded base, and for screwing the threaded seal portion 62 into the anchor with a tool inserted into tubular opening 94.

Anchor 66 is preferably a one piece molded construction, preferably of plastic.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. An apparatus for casting an internally threaded anchor in a concrete item in a mold having a mold wall comprising a hole in the mold wall, the apparatus comprising:

a first piece comprising:

a one piece molded plastic anchor comprising a first end, a second end, a first axis through said first end, an internally threaded first opening in said first end, said second end being closed, a portion of said anchor, spaced from said first end, being radially larger than said first end so that said anchor is held permanently in concrete when liquid concrete is added to the mold with the anchor mounted on the mold wall, and the concrete hardens, a second piece comprising:

a one piece plastic body comprising a third and eternally threaded to fit said internally threaded first opening, a fourth end, a second axis through said third end and said fourth end, a second axially extending opening in said third end, a third axially extending opening in ad fourth end, said fourth end on said body being configured for axially slidable close radial fit in the hole in the wall of the mold, comprising means for extending said body into said wall a first length of said body, a radially inward extending protrusion in said second opening, spaced from said third end and said forth end, for receiving a tool for transferring rotational force to said third end for screwing said body from said anchor.

2. The apparatus of claim 1 wherein said protrusion is recessed said first length from said fourth end.

3. The apparatus of claim 2 further comprising an annular member extending radially from said body so that said annular member seals said first opening when said third end is screwed into said first opening, one axial end of said radially inward extending protrusion being at the axial position of said annular member.

4. An apparatus for casting an internally threaded anchor in a concrete wall of a tank, in a mold for the tank having a mold wall comprising a hole in the mold wall, the apparatus comprising:

a first piece comprising:

a one piece plastic anchor comprising a first end, a second end, a first axis through said first end, an internally threaded first opening in said first end, said second end being closed, a portion of said anchor extending radially from said first axis, configured so that said anchor is held permanently in concrete when liquid concrete is added to the mold and the concrete hardens, a second piece comprising:

a one piece plastic body comprising a third end externally threaded to fit said first opening, a fourth end, a second axis through said third end, said fourth end being configured fort axially slidable close radial fit in said mold in the mold wall, a second opening in said fourth end extending toward said third end, an annular member extending radially from said body so that said annular member seals said first opening when said third end is screwed into said first opening, a radially inward extending protrusion in said second opening, spaced from said fourth end, configured for receiving a tool for transferring rotational force to said body for screwing said body out of said anchor, one axial end of said protrusion being at tho axial position of said annular member so that said protrusion in said second opening provides radial inward reinforcement of the body at said annular member so that said body shears adjacent to said annular member.

5. An apparatus for casting an internally threaded anchor in concrete wall of a tank, in a mold for the tank having a mold wall comprising a hole in the mold wall, the apparatus comprising:

a first piece comprising:

a one piece frustoconical molded plastic anchor comprising a first end, a second end, a first axis through said first end, an internally threaded first opening in said first end, said second end being closed, said second end being larger than said first end so that said anchor is held permanently in concrete when liquid concrete is added to the mold with the anchor mounted on the mold wall, and the concrete hardens, a second piece comprising:

a one piece plastic body comprising a third end externally threaded to fit said first opening, a fourth end, a second axis through said third end, said forth end being configured for axially slidable close radial fit in said hole in the mold wall, a second opening in said third end extending toward said fourth end, a third opening said fourth end extending toward said third end an annular member extending radially from said body so that said annular member seals said first opening when said third end is screwed into said first opening, a protrusion in said third opening, spaced from said forth end, configured for receiving a tool for transferring rotational force to said body for screwing said body out of said anchor, one axial end of said protrusion being configured at the axial position of said annular member so that said protrusion in said third opening provides radial inward reinforcement of the body at said annular member so that said body shears adjacent to said annular member.

6. The apparatus of claim 5 wherein said second opening connects with said third opening.

7. An apparatus for casting an internally threaded anchor in a concrete wall of a tank, cast in concrete in a mold for the tank having a mold wall closing a hole in the mold wall, comprising:

a one piece plastic anchor comprising a first end, a second end, a first axis through said first end, an internally threaded first opening in said first end, said second end being closed, cast in said concrete, a portion of said anchor extending radially from said first axis, configured so that said anchor is held permanently in said concrete, a one piece plastic body comprising a third end externally threaded to fit said first opening screwed in said first opening, a fourth end, a second axis through said third end, said fourth end being configured for axially slidable close radial fit in said hole in the mold wall, extending into said hole in said mold wall, a second opening in said fourth end extending toward said third end, an annular member extending radially from said body, sealing said first opening, a radially inward extending protrusion in said second opening, spaced from said fourth end, configured for receiving a tool for transferring rotational force to said body for screwing said body out of said anchor, one axial end of said protrusion being at the axial position of said annular member so that said protrusion in said second opening provides radial inward reinforcement of the body at said annular member so that said body shears adjacent to said annular member when said tank is removed from said mold wall.

* * * * *

UNITED STATES PATENT AND TRADEMARK OFFICE

CERTIFICATE OF CORRECTION

PATENT NO. : 6,789,776 B1
DATED : September 14, 2004
INVENTOR(S) : Norman W. Gavin It is certified that error appears in the above-identified patent and that said Letters Patent is hereby corrected as shown below:

Column 3,
Line 66, after "comprising a third", delete "and eternally" and replace therewith -- end externally --.

Column 4,
Line 3, after "a third axially extending opening in", delete "ad" and replace therewith -- said --.
Line 37, after "end being configured", delete "fort" and replace therewith -- for --,
Line 38, after "close radial fit in said", delete "mold" and replace therewith -- hole --,
Line 49, after "of said protrusion being at", delete "tho" and replace therewith -- the --,
Line 56, between "in" and "concrete wall" insert -- a --.

Column 5,
Line 8, after "a third opening", insert -- in --,
Line 28, after "the tank having a mold wall", delete "closing" and replace therewith -- comprising --.

Signed and Sealed this

Eleventh Day of January, 2005

JON W. DUDAS
*Director of the United States Patent and Trademark Office*